US007621530B2

(12) United States Patent
Lany et al.

(10) Patent No.: US 7,621,530 B2
(45) Date of Patent: Nov. 24, 2009

(54) DISC GAME APPARATUS AND METHOD OF PLAYING THE SAME

(76) Inventors: Mark Lany, 51 President Drive, Stoney Creek, Ontario (CA) L8G 4H2; Robert Bratina, 568 Eleventh Rd E, Stoney Creek, Ontario (CA) L8J 3N8

( * ) Notice: Subject to any disclaimer, the term of this patent is extended or adjusted under 35 U.S.C. 154(b) by 0 days.

(21) Appl. No.: 11/832,694

(22) Filed: Aug. 2, 2007

(65) Prior Publication Data

US 2009/0033031 A1 Feb. 5, 2009

(51) Int. Cl.
*A63F 7/06* (2006.01)

(52) U.S. Cl. ..... 273/126 R

(58) Field of Classification Search ..... 273/108, 273/108.1, 108.4, 126 R, 126 A; 473/588
See application file for complete search history.

(56) References Cited

U.S. PATENT DOCUMENTS

| | | | | | |
|---|---|---|---|---|---|
| 1,296,111 | A | * | 3/1919 | Olson | 273/126 R |
| 2,719,717 | A | | 10/1955 | Vertiy | |
| 3,572,717 | A | * | 3/1971 | Anguella | 273/126 R |
| 3,947,035 | A | | 3/1976 | Bouchard | |
| 4,000,900 | A | | 1/1977 | Lehmann | |
| 4,017,079 | A | | 4/1977 | Apellaniz | |
| 4,294,449 | A | | 10/1981 | Shaw | |
| 4,348,026 | A | | 9/1982 | Kauffmann | |
| 4,519,611 | A | | 5/1985 | Sands | |
| 4,548,409 | A | | 10/1985 | Cacho | |
| 4,555,114 | A | * | 11/1985 | Dozier | 473/588 |
| 4,995,611 | A | | 2/1991 | Goldthorpe | |
| 5,011,147 | A | | 4/1991 | Thomas et al. | |
| 5,465,962 | A | | 11/1995 | Hiserman | |
| 5,556,095 | A | | 9/1996 | Stites | |
| 5,570,888 | A | * | 11/1996 | Robinson et al. | 273/317.5 |
| 5,673,912 | A | * | 10/1997 | Bonk | 273/108.4 |
| 5,687,966 | A | * | 11/1997 | Barnhart et al. | 273/108.1 |
| 6,893,017 | B1 | | 5/2005 | Thomas et al. | |
| 2007/0075485 | A1 | | 4/2007 | Derman et al. | |

* cited by examiner

*Primary Examiner*—Raleigh W. Chiu
(74) *Attorney, Agent, or Firm*—Maxey Law Offices, PLLC; Stepen Lewellyn

(57) ABSTRACT

A game apparatus of the type where a projectile, such as a disc is hand propelled across an elongated playing surface from a launch area to a target area and a new method of playing such a game. The method of playing including awarding points to a player for each disc that is successfully slid across the playing surface from the launch area to the target area and positions the disc to hang over the edge of the playing surface without falling off the playing surface.

3 Claims, 2 Drawing Sheets

DISC GAME APPARATUS AND METHOD OF PLAYING THE SAME

BACKGROUND OF THE INVENTION

1. Field of the Invention

The present invention relates generally to a game apparatus of the type wherein a slider, such as a disc or puck, is hand propelled to slide along an elongated surface from a launch area to a target area.

2. Description of the Related Art

Table level games involving the skillful sliding of a slider across a playing surface from a launch zone to a target zone are commonly available in coin operated devices found in amusement places as well as for home use. Table level shuffle board is one of the more popular of this the type of game. These types of games include a myriad of different target designs graphically marked on the playing surface where the purpose of the game is to propel at least one slider from one side of the playing surface (the launch zone) to the opposite side of the playing surface (the target zone) in an attempt to position the slider in a specified area of the target design. Typically, the target design is configured to have areas of varying degrees of difficulty in positioning a slider and usually increasing point values are award for successfully placing a slider in these areas.

SUMMARY OF THE INVENTION

The present invention is directed to a more challenging game apparatus and method of playing the same of the type wherein a slider, such as a disc or puck, is hand propelled to slide over an elongated playing surface from a launch zone to a target zone, and instead of providing a target design on the playing surface for scoring a more challenging scoring method is provided where the slider must be positioned to hang of the edge of the playing surface without falling in order to score a point value.

In general, in one aspect, a method of playing a disc game on a game apparatus having a horizontal rectangular base about whose periphery are mounted walls which serve to contain the discs on the game apparatus, a smooth and hard playing surface is located above the base and within the rectangular area bounded by the walls, the raised playing surface is spaced from the interior surfaces of the walls to form a gutter zone into which discs may fall, the playing surface is separated into three zones by a pair lines each extending transversely across the playing surface at a spaced distance from each end of the playing surface is provided. The method of play including the steps of:

(a) providing a plurality of discs adapted to be slid across a playing surface;

(b) individually sliding one disc at a time from a first end of the playing surface towards the opposite second end of the playing surface in an attempt to position each disc at the opposite end so that discs hang over the edge but do not fall off the playing surface;

(c) calculating a first set of points scored for each disc that is positioned to hang off the edge of the playing surface;

(d) individually sliding one disc at a time from the second end of the playing surface towards the first end thereof in an attempt to position each disc at the first end so that the discs hang over the edge but do not all off the playing surface;

(e) calculating a second set of points scored for each disc that is positioned to hang off the edge of the playing surface; and (f) repeating steps (b)-(e) until one set of points reaches a predetermined point value required to win the game.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
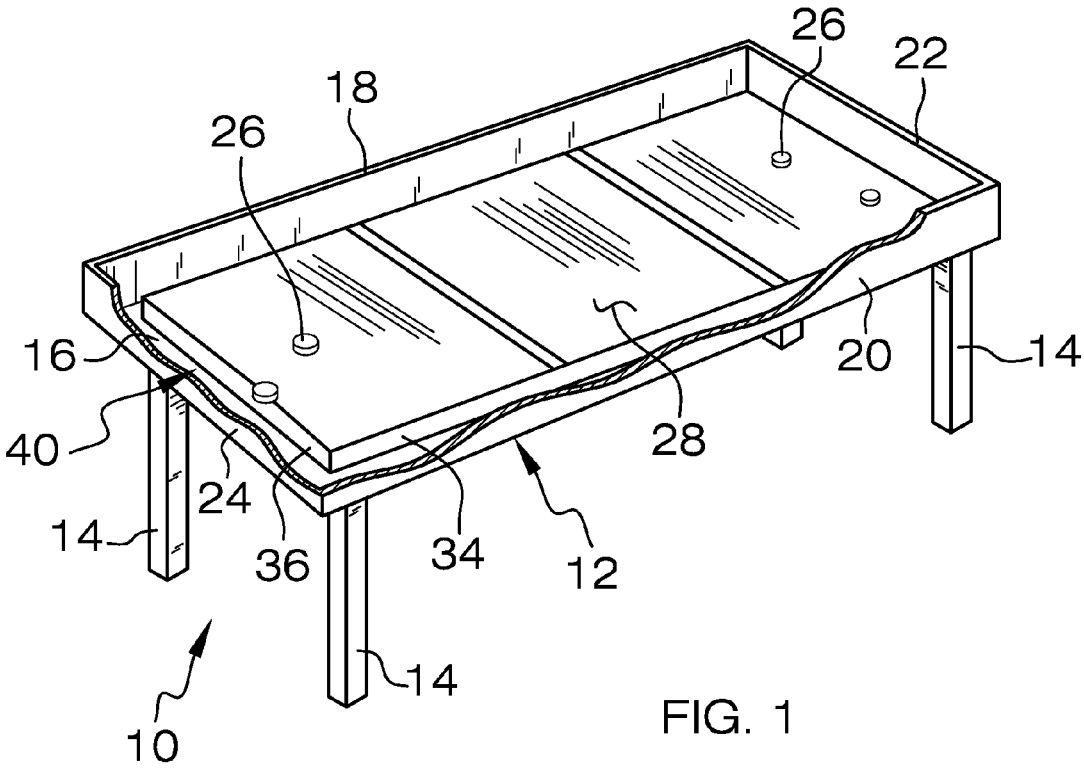
FIG. 1 is a diagrammatic perspective view of a game apparatus constructed in accordance with the principles of the present invention.

Referring now to FIGS. 1-4 of the drawings, reference numeral 10 generally designates the disc game apparatus for using in the method of playing a more challenging table game of the type where a slider is hand propelled across an elongated surface from a launch are to a target area.

Figure 2:
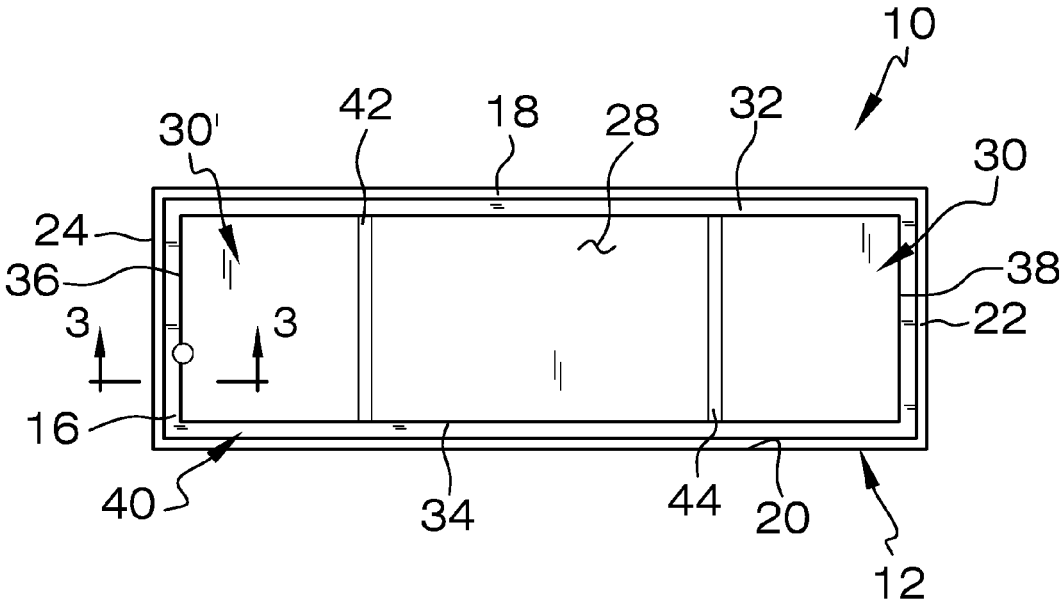
FIG. 2 is a top plan view of the game apparatus.

With particular reference to FIGS. 1 and 2, the game apparatus 10 includes an assembly 12 that can be supported by legs 14 at the desired height. The assembly 12 includes an elongated rectangular and horizontal base 16. A plurality of side walls 18, 20, 22, 24 are mounted about the periphery of the base 16 and serve to contain the sliders such as the discs 26 on the assembly 12. The side walls 18-24 include a pair of parallel side walls 18, 20 and two end walls 22, 24.

Raised above the base 16 and within the rectangular area bounded by the side walls 18-24 is a smooth and hard playing surface 28. At each end of the playing surface 28 there are launch/target areas indicated by reference characters 30, 30'. The playing surface 28 is a rigid non-flexible surface. The playing surface 28 is supported above the base 16 by side walls 32, 34 and end walls 36, 38. The playing surface 28 is spaced from the interior surface of walls 18-24 to form a "gutter" or "pit" 40 into which the discs 26 can fall.

Methodology Behind the Game

The method of playing the game provides a more challenging game play to table games of the type where a slider is hand propelled across a playing surface from a launch area to a target area, and to teach the principals of "Honour", "Respect", and "Fairness" to the game players.

Method of Play

The object of the game is to score more points than your opponent by launching a plurality of discs 26 one at a time from one side (launch area) of the playing surface 28 to the opposite side (target area) in attempt to position each slider such that it hangs over the edge of the playing surface without falling into the pit 40. A typical game is played to 5 points. In a more challenging mode of play, a player must have two or more points higher than his or her opponent to win the game.

To begin the game, each opponent slides a single disc 26 from the same side of the playing surface 28 in an attempt to position the disc as close to the edge of the opposite side of the playing surface without causing the disc to fall off the playing surface. The player who wins this challenge is chosen to begin the game.

Unlike prior table games of the same or similar type, the players are positioned at opposite ends of the playing surface 28 and alternate in propelling all of the same discs 26, one at a time, from their respective launch area to their respect target area. For example, in a single round of play one player will propel all the discs 26, one at a time, from the respective launch area to the respective target area. Then points are awarded for each disc 26 that hangs off the edge of the playing surface but does not fall into the pit 40. Next, the second player, propels all of the discs 26, one at a time, from the respective launch area to the respective target area. Then points are awarded for each disc 26 that hangs off the edge of the playing surface but does not fall into the pit 40. This alternating play continues until one player reaches a total number of points determined to win the game.

In another aspect, the game may be played until one player reaches a total number of points determined to win the game and is head of the opponent by at least two points.

In another aspect, the game may be played until one player reaches a total number of points determined to win the game and is head of the opponent by at least two points, thereby causing a situation called "last breath" is entered. In "last breath" the trailing player is allowed a single round of play in attempt to come within one point or to tie the leading player. If the trailing player is successful in this attempt the game will resume normal play.

In another aspect, the game may be played until one player reaches a total number of points determined to win the game and is head of the opponent by at least two points, thereby causing a situation called "last breath". The leading player upon scoring the second leading point and causing the "last breath to occur" is forced to end his or her round and hand all of the discs 26 to the trailing opponent. The trailing player is allowed a single round of play in attempt to come within one point or to tie the leading player. If the trailing player is successful in this attempt the game will resume normal play.

In another aspect, a pair of survival lines 42, 44 may extend transversely across the playing surface 28 with one positioned at a spaced distance from each end of the playing surface. In game play, a disc 26 must be propelled or slide past the survival line 42, 44 closest to the end from which the discs are being launched to become a "live" disc. In other words, if a disc 26 is not propelled beyond the survival line 42, 44 it is deemed to be a "dead" disc and must remain in position on the playing surface 28 for the remainder of the player's round of shooting. If at anytime a second disc 26 is caused to strike the "dead" disc, the player is penalized by having the particular shooting round end and must hand all of the discs to the opponent.

In another aspect, all of the discs 26 must remain visible by both players or teams during the entire game play.

In another aspect, if a player, during his or her round of shooting accidentally knocks a disc 26 into the pit 40, the disc is considered dead and cannot be played.

In another aspect, once a disc 26 is propelled by a player, the disc is considered in-play, and if the disc is touched by any player while in play, that player forfeits either current round if the player is the shooter or is forced to skip the next round if the player is not the shooter.

Scoring is awarded as followed:

Two points are awarded by sliding a disc 26 so that is hangs over the edge of the playing surface 28 without falling off the playing surface and without contacting another disc.

One point is awarded by sliding a disc 26 and hitting another disc so it hangs over the edge of the playing surface 28 without falling off. It is possible to propel a disc 26 to hit more than one disc causing each disc that is struck to hang over the edge. A single point is awarded for each disc 26 that hangs off the edge of the playing surface without falling.

One point is awarded by sliding a disc 26 off the playing surface 28 such that hits any part the assembly 12 and bounces back onto the playing surface and hangs over the edge and does not fall off.

Three points are awarded by sliding a disc 26 so that it hangs over the corner of the playing surface and without contacting another disc, i.e. a portion of the disc hangs over both the edge and side of the playing surface without falling off.

Figure 3:
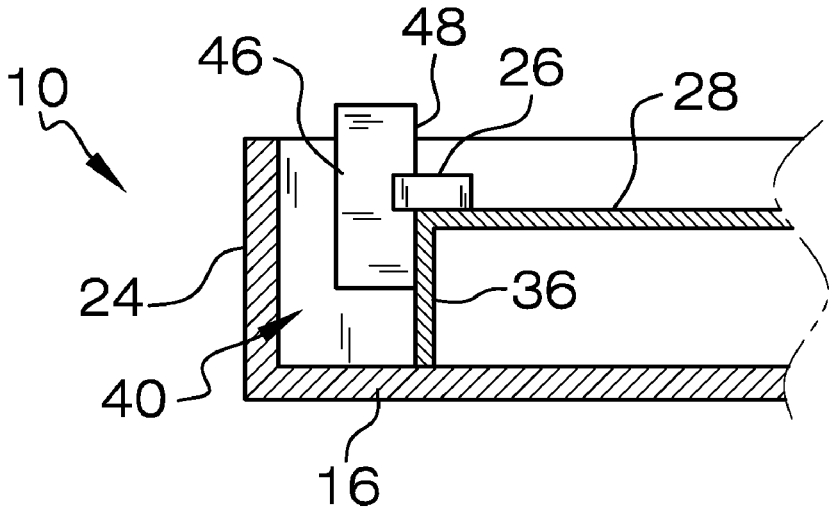
FIG. 3 is a side elevation view of a disc extending over the edge of the playing surface and being measured.

With particular reference to FIG. 3, in order to determine if points should be awarded for positioning a disc 26 over the edge of the playing surface 28 without falling off, a measurement of the disc position must be made. The measurement is made using a measuring block 46 that includes at least one flat surface 48. The flat surface 48 is placed flush against the side wall 32-38 to which the disc 26 is to be measured such that the flat surface extends above the playing surface 28 at of a height at least equal to the thickness of the disc. The measuring block 46 is then move across the side wall 32-38 while maintaining the flat surface 48 flush thereagainst. As the measuring block 46 is moved past the disc 26 and if there is motion in the disc, points are awarded accordingly.

Figure 4:
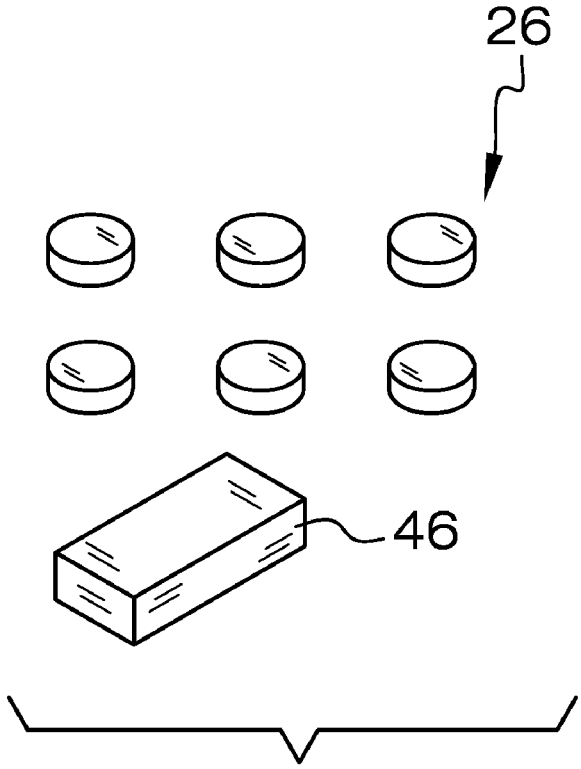
FIG. 4 is a diagrammatic view of game equipment.

Turning now to FIG. 4, the game apparatus 10 is provided with a plurality of discs 26 and a measuring block 46. While any number of discs 26 may be provided, six discs is the preferred number.

A number of embodiments of the present invention have been described. Nevertheless, it will be understood that various modifications may be made without departing from the spirit and scope of the invention. Accordingly, other embodiments are within the scope of the following claims.

We claim:

1. A method of playing a disc game, comprising the steps of:

(a) providing a game apparatus having a horizontal rectangular base about whose periphery are mounted walls which serve to contain the discs on the game apparatus, a smooth and hard playing surface is located above the base and within the rectangular area bounded by the walls, the raised playing surface is spaced from the interior surfaces of the walls to form a gutter zone into which discs may fall, the playing surface is separated into three zones by a pair lines each extending transversely across the playing surface at a spaced distance from each end of the playing surface;

(b) providing a plurality of discs adapted to be slid across a playing surface;

(c) individually sliding all of the discs one disc at a time from a first end of the playing surface towards the opposite second end of the playing surface in an attempt to position each disc at the opposite end so that discs hang over the edge but do not fall off the playing surface;

(d) calculating a first set of points scored for each disc that is positioned to hang off the edge of the playing surface;

(e) individually sliding all of the discs one disc at a time from the second end of the playing surface towards the first end thereof in an attempt to position each disc at the first end so that the discs hang over the edge but do not all off the playing surface;

(f) calculating a second set of points scored for each disc that is positioned to hang off the edge of the playing surface; and (g) repeating steps (c)-(f) until one set of points reaches a predetermined point value required to win the game wherein steps (b) and (e) each disc must be slid past the closest transverse line to the end from which the discs are being launched, thereby avoiding becoming a dead disc; and wherein steps (b) and (e) should a subsequently slid disc strike a dead disc the discs remaining to be slid are not slid and steps (c) and (f) respectively are skipped.

2. The method of claim 1, wherein steps (b) and (e) a disc is forfeited if it is slid into the gutter zone of the game apparatus.

3. The method of claim 1, wherein step (c) all of the discs are slid prior to step (d) and further wherein step (c) all of the discs are slid prior to step (f).

* * * * *